US009243829B1

(12) United States Patent
Parnell

(10) Patent No.: US 9,243,829 B1
(45) Date of Patent: Jan. 26, 2016

(54) VEHICLE AIR CONDITIONING CHARGING HOSE ASSEMBLY AND METHOD

(71) Applicant: E. Lynn Parnell, Cornelius, NC (US)

(72) Inventor: E. Lynn Parnell, Cornelius, NC (US)

( * ) Notice: Subject to any disclaimer, the term of this patent is extended or adjusted under 35 U.S.C. 154(b) by 0 days.

(21) Appl. No.: 14/531,382

(22) Filed: Nov. 3, 2014

Related U.S. Application Data

(63) Continuation-in-part of application No. 12/788,564, filed on May 27, 2010, now Pat. No. 8,875,524.

(51) Int. Cl.
*F25B 45/00* (2006.01)
*F25D 27/00* (2006.01)

(52) U.S. Cl.
CPC ..... *F25B 45/00* (2013.01); *F25D 27/00* (2013.01); *F25B 2345/001* (2013.01); *F25B 2345/006* (2013.01)

(58) Field of Classification Search
CPC ..... F25B 45/00; F25B 2345/001; F25B 2345/006; F25B 2700/04
USPC ..... 62/292
See application file for complete search history.

(56) References Cited

U.S. PATENT DOCUMENTS

| | | | | |
|---|---|---|---|---|
| 3,712,113 | A | 1/1973 | Roscoe | 73/37 |
| 3,813,893 | A | 6/1974 | Gemender et al. | 62/129 |
| 3,916,641 | A | 11/1975 | Mullins | 62/292 |
| 3,935,713 | A | 2/1976 | Olson | 62/77 |
| 3,976,110 | A | 8/1976 | White | 141/346 |
| 4,311,023 | A | 1/1982 | Watral | 62/468 |
| 4,319,459 | A | 3/1982 | Hannett et al. | 62/77 |
| 4,884,410 | A | 12/1989 | Bell et al. | 62/77 |
| 4,941,600 | A | 7/1990 | Berriochoa et al. | 222/402.13 |
| 5,090,212 | A | 2/1992 | Keltner et al. | 62/149 |
| 5,117,641 | A | 6/1992 | Keltner | 62/85 |
| 5,168,720 | A | 12/1992 | Keltner | 62/292 |
| 5,218,831 | A | 6/1993 | Keltner | 62/77 |
| 5,220,810 | A | 6/1993 | Keltner | 62/292 |
| 5,231,843 | A | 8/1993 | Keltner | 62/77 |
| 5,247,803 | A | 9/1993 | Adams et al. | 62/77 |
| 5,247,812 | A | 9/1993 | Keltner | 62/475 |
| 5,295,367 | A | 3/1994 | Keltner | 62/292 |
| 5,333,467 | A | 8/1994 | Pearl, II et al. | 62/77 |
| 5,577,709 | A | 11/1996 | Gugala et al. | 251/315.14 |
| 6,089,032 | A | 7/2000 | Trachtenberg | 62/149 |
| 6,360,554 | B1 | 3/2002 | Trachtenberg | 62/292 |
| 6,385,986 | B1 | 5/2002 | Ferris et al. | 62/292 |
| 6,446,453 | B1 | 9/2002 | Trachtenberg | 62/292 |

(Continued)

OTHER PUBLICATIONS

One page printout showing "Measuring & Dispensing" charging hoses of Interdynamics from the 2005 Auto Air Conditioning Product Catalog.

*Primary Examiner* — Jonathan Bradford
*Assistant Examiner* — Orlando Aviles Bosques
(74) *Attorney, Agent, or Firm* — Blake P. Hurt; Tuggle Duggins P.A.

(57) ABSTRACT

Air conditioning charging hose assembly and method allows for quick, safe and reliable air conditioning system testing and charging. The assembly includes a shut-off valve positioned proximate the supply fitting to allow a technician to quickly shut-off the refrigerant gas supply. The method also allows the technician to test the vehicle air conditioning system pressure when charging as the hose assembly is connected to the air conditioning system and when disconnected from the air conditioning system, allows the technician to determine the refrigerant gas canister pressure.

19 Claims, 10 Drawing Sheets

(56) References Cited

U.S. PATENT DOCUMENTS

| | | | | |
|---|---|---|---|---|
| 6,467,283 | B1 | 10/2002 | Trachtenberg | 62/149 |
| 6,609,385 | B1 | 8/2003 | Ferris et al. | 62/77 |
| 6,698,466 | B1 | 3/2004 | Cowan et al. | 141/67 |
| 6,722,141 | B2 | 4/2004 | Ferris et al. | 62/77 |
| 6,796,340 | B1 | 9/2004 | Ferris et al. | 141/67 |
| D511,307 | S | 11/2005 | Cowan et al. | D10/85 |
| 6,978,636 | B2 | 12/2005 | Motush et al. | 62/292 |
| 7,077,171 | B2 | 7/2006 | Carrubba | 141/1 |
| 7,107,781 | B2 | 9/2006 | Quest et al. | 62/292 |
| 7,260,943 | B2 | 8/2007 | Carrubba et al. | 62/77 |
| 7,275,383 | B2 | 10/2007 | Motush et al. | 62/292 |
| 2006/0101834 | A1 | 5/2006 | Govekar et al. | 62/149 |

VEHICLE AIR CONDITIONING CHARGING HOSE ASSEMBLY AND METHOD

This is a continuation-in-part of and claims benefits under pending prior application Ser. No. 12/788,564 filed 27 May 2010, now U.S. Pat. No. 8,875,524, which is incorporated by reference in its entirety herein.

FIELD OF THE INVENTION

The invention herein pertains to an assembly and method to quickly, efficiently test and charge air conditioning (AC) systems and particularly pertains to an assembly and method for vehicle air conditioning systems.

DESCRIPTION OF THE PRIOR ART AND OBJECTIVES OF THE INVENTION

Servicing air conditioning (AC) systems, especially for automobiles and other vehicles has become increasingly frequent, costly and competitive in recent years. Practically all U.S. cars and trucks are now equipped with air conditioning systems and it is recommended that these systems have at least annual testing and maintenance including charging to insure proper operation.

In order to provide proper and accurate testing and servicing of vehicle air conditioner systems, various types of tools and equipment have been manufactured to aid technicians, retail customers and others to insure proper servicing. In commercial shops and garages it is conventional to purchase refrigerant gas canisters which are threaded onto a hose assembly which is then connected to the vehicle air conditioning system for charging. The canister is punctured thereby releasing the refrigerant gas which flows generally through a hose and a gauge into the vehicle AC service port inlet. Typical hose assemblies are shown such as in U.S. Pat. Nos. 6,385,986 and 6,609,385 ('385) of Ferris et al., U.S. Pat. No. 6,978,636 of Motush et al. and U.S. Pat. No. 6,360,554 of Trachtenberg. These devices generally have a refrigerant gas canister fitting and a service port coupler whereas Motush et al. and Ferris et al. ('385) further include a gauge. Ferris et al. ('385) also utilizes a check valve downstream of the gauge. While these and other prior devices work well under normal circumstances additional features are desired to promote efficiency and save time, labor and to increase the safety of the servicing technician.

For these and other reasons the present invention was conceived and one of its objectives is to present an air conditioning charging hose assembly and method of use which includes a quick-turn shut-off valve positioned between the refrigerant supply fitting and the service port inlet coupler for quickly terminating the flow of refrigerant gas from the canister.

It is another objective of the present invention to provide a method for a service technician to more accurately test and charge a vehicle air conditioning system.

It is still another objective of the present invention to provide an air conditioning charging hose assembly having a gauge and shut-off valve which is conveniently located to allow the technician to pressure test both the refrigerant gas canister and the vehicle air conditioning system without having to always disassemble or disconnect the air conditioning charging hose assembly.

It is a further objective of the present invention to provide an air conditioning charging hose assembly which is relatively inexpensive to produce and which is safe and easy to use.

Various other objectives and advantages of the present invention will become apparent to those skilled in the art as a more detailed description is set forth below.

SUMMARY OF THE INVENTION

The aforesaid and other objectives are realized by providing an air conditioning charging hose assembly and method particularly for use on vehicle air conditioning systems. The preferred hose assembly is provided with a service port inlet coupler, a first hose section, a pressure gauge with charge markings on the face, a second hose section, a shut-off valve and a refrigerant supply fitting with a rotatable needle and knob for connection to a refrigerant gas canister. The hose assembly with the shut-off valve in a closed position is connected by the service port inlet coupler to a vehicle air conditioning system. A refrigerant gas canister is then threadably connected to the refrigerant supply fitting. The gas canister may supply refrigerant gases, oil, dyes or other additives to the air conditioning system. The needle of the supply fitting is rotated by the knob to puncture the seal of a refrigerant gas canister whereby the shut-off valve can be opened to allow refrigerant gas to flow from the canister into the hose assembly and vehicle air conditioning system. A quick-turn shut-off valve is positioned at the end of the second hose section proximate the refrigerant supply fitting to allow the user to quickly discontinue the refrigerant gas flow into the vehicle air conditioner system as needed after the canister is punctured and before exhaustion. The quick-turn shut-off valve also allows the technician to remove or change the canister without removing the hose assembly from the vehicle air conditioning system, thus preventing loss of refrigerant gases into the environment.

The method of use allows the hose assembly to remain connected to the vehicle air conditioner system while supplying refrigerants and/or testing the pressure of either the vehicle air conditioning system or the refrigerant gas canister since the quick-turn shut-off valve is positioned on the hose between the pressure gauge and the refrigerant supply fitting.

In another embodiment of the invention the refrigerant supply fitting includes a fixed needle which penetrates or punctures the refrigerant gas canister seal as the canister is threaded into the supply fitting.

In a further embodiment, the charging hose assembly does not include a pressure gauge for economy purposes.

DETAILED DESCRIPTION OF THE PREFERRED EMBODIMENT AND OPERATION OF THE INVENTION

Figure 1:
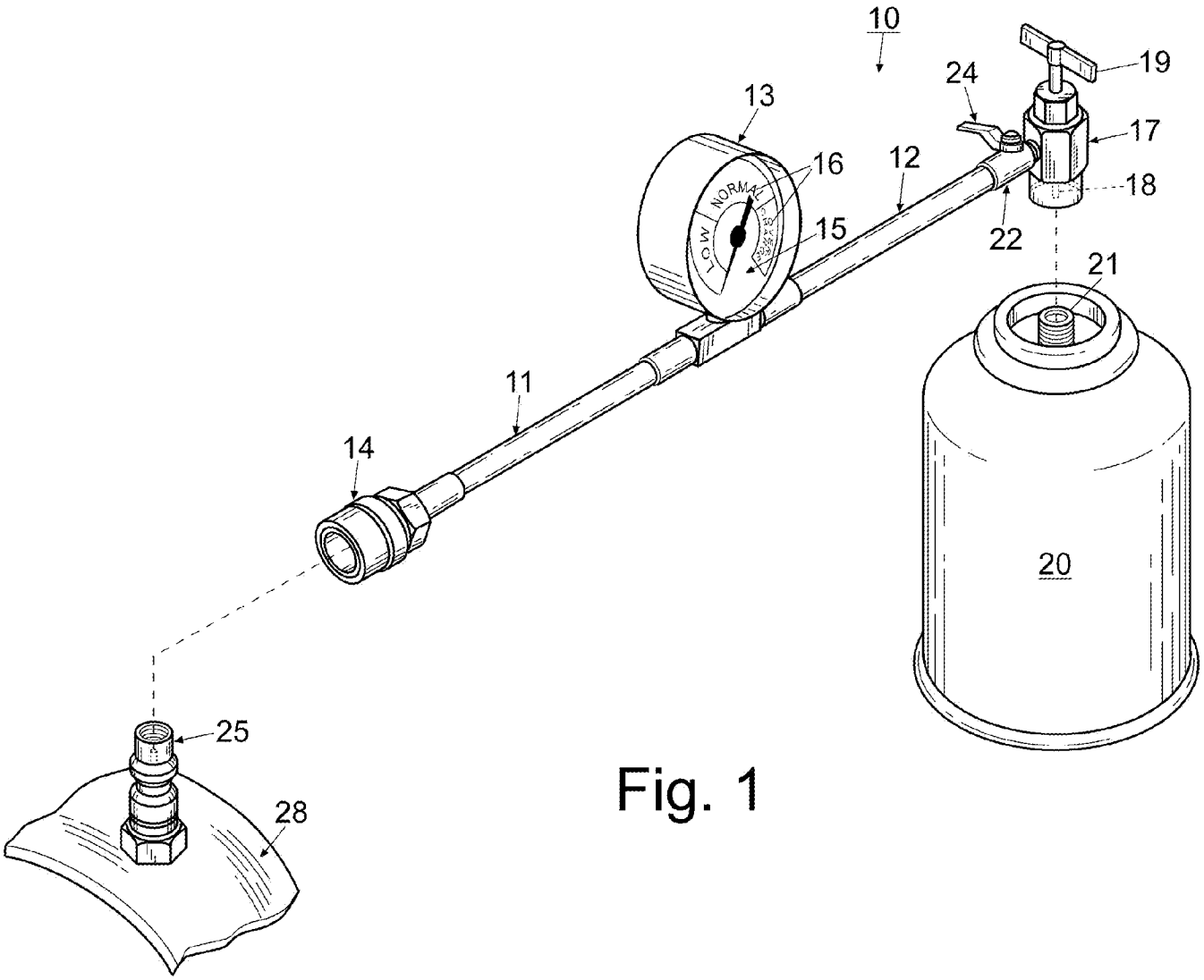
FIG. 1 demonstrates the preferred air conditioning charging assembly utilizing a rotatable knob and needle to rupture the refrigerant gas canister in use.

For a better understanding of the invention and its operation, turning now to the drawings, FIG. 1 shows preferred air conditioning charging hose assembly 10 having first flexible hose section 11 connected at one end to conventional service port inlet coupler 14 and standard pressure gauge 13 with a face 15 with charge (zone) markings 16 indicating a low charge (low pressure), a normal charge or overcharge connected to the other end. Charge markings 16 may be indicated by numbers, colors or both. Service port inlet coupler 14 is a conventional quick coupler which is normally closed but other embodiments such as a normally open service port coupler may be employed depending on the particular manufacturer and system to be serviced. Service port inlet coupler 14 engages standard inlet 25 of vehicle air conditioning system 28 (shown schematically) for fluid flow therebetween. Second flexible hose section 12 is connected at one end to pressure gauge 13 and shut-off valve 22 having finger lever 24 connected to the other end. Shut-off valve 22 is connected to and in fluid communication with refrigerant gas supply fitting 17 having knob 19 for threadably connecting to a standard refrigerant gas supply such as refrigerant gas canister 20 which may supply refrigerant gases, oil, dyes or other additives to air conditioning system 28.

Refrigerant supply fitting 17 includes internal threads for receiving threaded outlet 21 of refrigerant gas canister 20. Refrigerant supply fitting 17 includes a standard rotatable solid fitting needle 18 having knob 19 for rotating needle 18 to extend and thereby puncture the seal (not shown) of refrigerant gas canister 20 allowing the flow of refrigerant gas around solid needle 18 from canister 20 through hose assembly 10 into vehicle air conditioning system 28. Refrigerant gas canister 20 has a threaded top with standard puncture type seal for use with supply fitting 17 which could be replaced with a supply fitting (not shown) for use with a "snap-on" canister (not shown) having a usual mechanical or manual gas release valve such as used on spray paint cans.

Shut-off valve 22 positioned at the proximal end of second flexible hose section 12 is joined to and in communication with supply fitting 17. Second hose section 12 is likewise connected at its distal end to standard pressure gauge 13. Typical shut-off valve 22 includes finger lever 24 for quick and easy manual manipulation to start or stop the flow of refrigerant gas from canister 20. Shut-off valve 22 is a typical "quick-turn" shut-off valve in that finger lever 24 only rotates about ¼ turn from a fully open position to a fully closed position. Quick action shut-off valve 22 allows for rapid response and convenient control while supplying usual refrigerant gas such as R134a (not seen) from refrigerant gas canister 20 to inlet 25 of vehicle air conditioning system 28. Shut-off valve 22 allows a technician to remove canister 20 or change refrigerant gas canisters without removing hose assembly 10 from air conditioning system 28, thus preventing the harmful release of refrigerant gases into the atmosphere.

When service port inlet coupler 14 is removed from inlet 25, service port inlet coupler 14 closes which allows refrigerant gas canister 20 to be pressure tested with quick-turn shut-off valve 22 opened by reading markings 16 on face 15 of pressure gauge 13.

Quick-turn shut-off valve 22 is positioned for convenience and rapid operation and easy adjustment of refrigerant gas flow, thus allowing a technician to more precisely add the correct amount of refrigerant gas to charge air conditioning system 28. Further, servicing is faster and safer in that the refrigerant gas flow from refrigerant gas canister 20 can be cut-off quickly by finger lever 24 of shut-off valve 22, if necessary. In addition, quick-turn shut-off valve 22 allows hose assembly 10 to remain joined to refrigerant gas canister 20 after charging or testing is completed. Shut-off valve 22 further allows the technician to check the pressure of air conditioning system 28 while refrigerant gas canister 20 is connected and during the process of charging vehicle air conditioning system 28. When shut-off valve 22 is closed by lever 24, the pressure of vehicle air conditioning system 28 is tested and as necessary, shut-off valve 22 can be opened by lever 24 to finish charging air conditioning system 28 from refrigerant gas canister 20.

In the method of servicing a typical air conditioning system, such as vehicle air conditioning system 28, hose assembly 10 is connected to air conditioning system 28 by connecting service port inlet coupler 14 to inlet 25 with shut-off valve 22 closed by finger lever 24. With hose assembly 10 so connected, pressure gauge 13 is read to determine the pressure of refrigerant within vehicle air conditioning system 28. Next, if system 28 is low on refrigerant as determined by the test, a canister of conventional refrigerant gas such as canister 20 is then threadably joined to supply fitting 17 as shown in FIG. 1. Once refrigerant gas canister 20 is threaded thereon, knob 19 is rotated allowing fitting needle 18 to puncture and penetrate the seal (not shown) of refrigerant gas canister 20. Next, finger lever 24 of quick-turn shut-off valve 22 is rotated ¼ turn to the open position, allowing gas from refrigerant gas canister 20 to flow through second hose section 12, pressure gauge 13, first hose section 11, through service port inlet coupler 14 into inlet 25 and into vehicle air conditioning system 28 for charging. Once air conditioning system 28 has been sufficiently charged shut-off valve 22 is then closed to stop the flow of refrigerant gas and pressure gauge 13 is read to test the pressure of vehicle air conditioning system 28. Should the pressure be insufficient shut-off valve 22 is opened by lever 24 to again supply refrigerant gas from canister 20 to system 28. This step in the charging process is repeated until pressure gauge 13 supplies a desired reading from system 28 as determined by the technician. Once pressure gauge 13 reaches its required reading, shut-off valve 22 is closed and service port inlet coupler 14 is thereafter disconnected from inlet 25 and automatically closes. The pressure of refrigerant gas remaining in canister 20 can then be tested by opening shut-off valve 22 and markings 16 of gauge 13 read and if empty canister 20 can be removed from supply fitting 17 and properly discarded. However, if refrigerant gas canister 20 is not empty and can be used again, shut-off valve 22 is closed to retain the refrigerant gas in canister 20 and hose assembly 10 can be stored with canister 20 still attached until another air conditioning system charging is needed.

Figure 2:
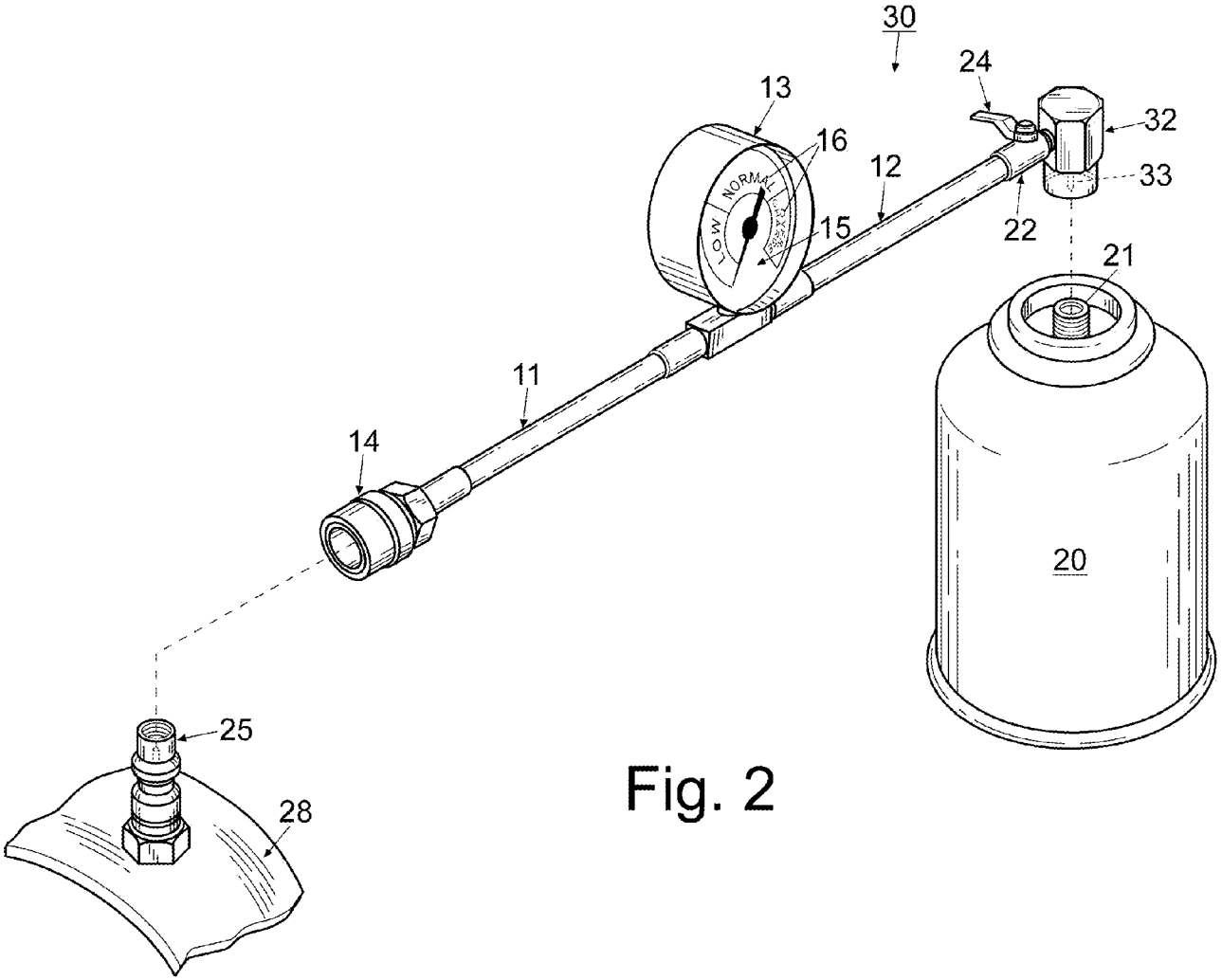
FIG. 2 illustrates an alternate embodiment of the hose assembly as shown in FIG. 1 having a fixed needle which threadably ruptures the refrigerant gas canister as the supply fitting is threaded onto the canister.

In FIG. 2, alternate charging hose assembly 30 is seen which is identical to charging hose assembly 10 except that supply fitting 32 includes fixed hollow needle 33 seen in dashed lines. Shut-off valve 22 with finger lever 24, hose sections 11 and 12, gauge 13 and service port inlet coupler 14 are all identical to those shown in preferred hose assembly 10 described above. As earlier explained, supply fitting 32 is threaded onto threaded outlet 21 of refrigerant gas canister 20 allowing fixed hollow needle 33 to rotate into and penetrate the seal (not seen) of canister 20, permitting refrigerant gas flow therethrough.

Figure 3:
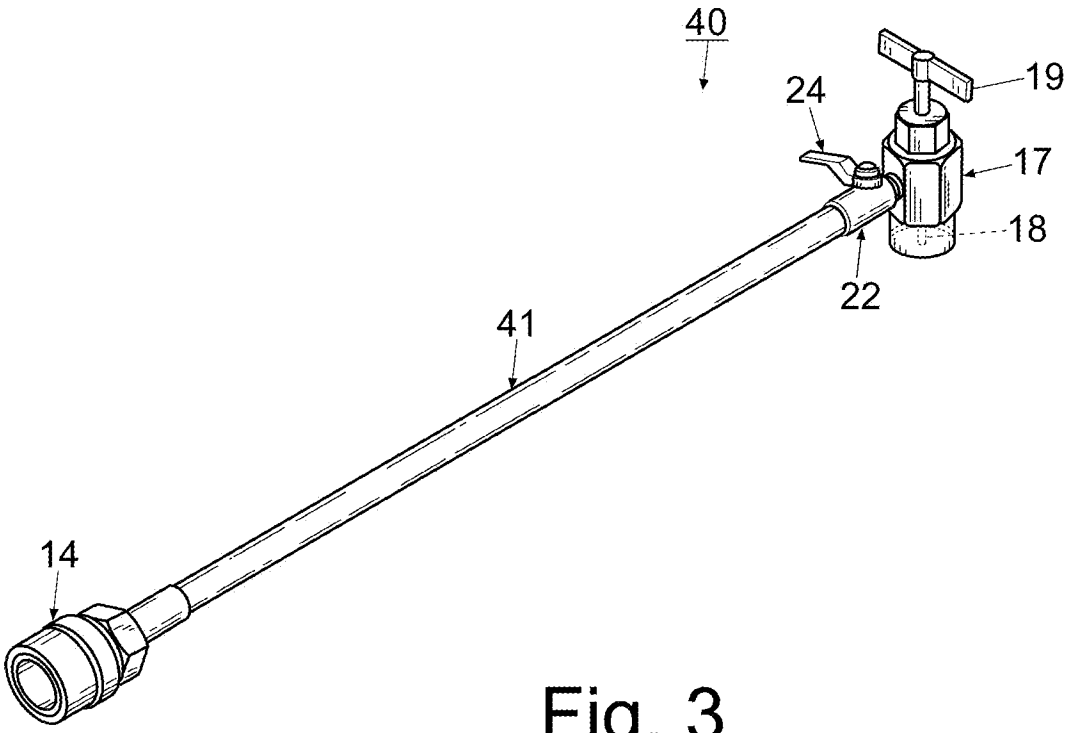
FIG. 3 shows another embodiment of the charging hose assembly without the pressure gauge.

A third embodiment of the charging hose assembly is seen in FIG. 3. Here no pressure gauge is provided on hose 41 of charging hose assembly 40. Shut-off valve 22 is available for use during the air conditioning system charging process. Hose assembly 40 is more economical to purchase but somewhat limits the technicians use and requires other equipment for air conditioning system pressure testing.

Figure 4:
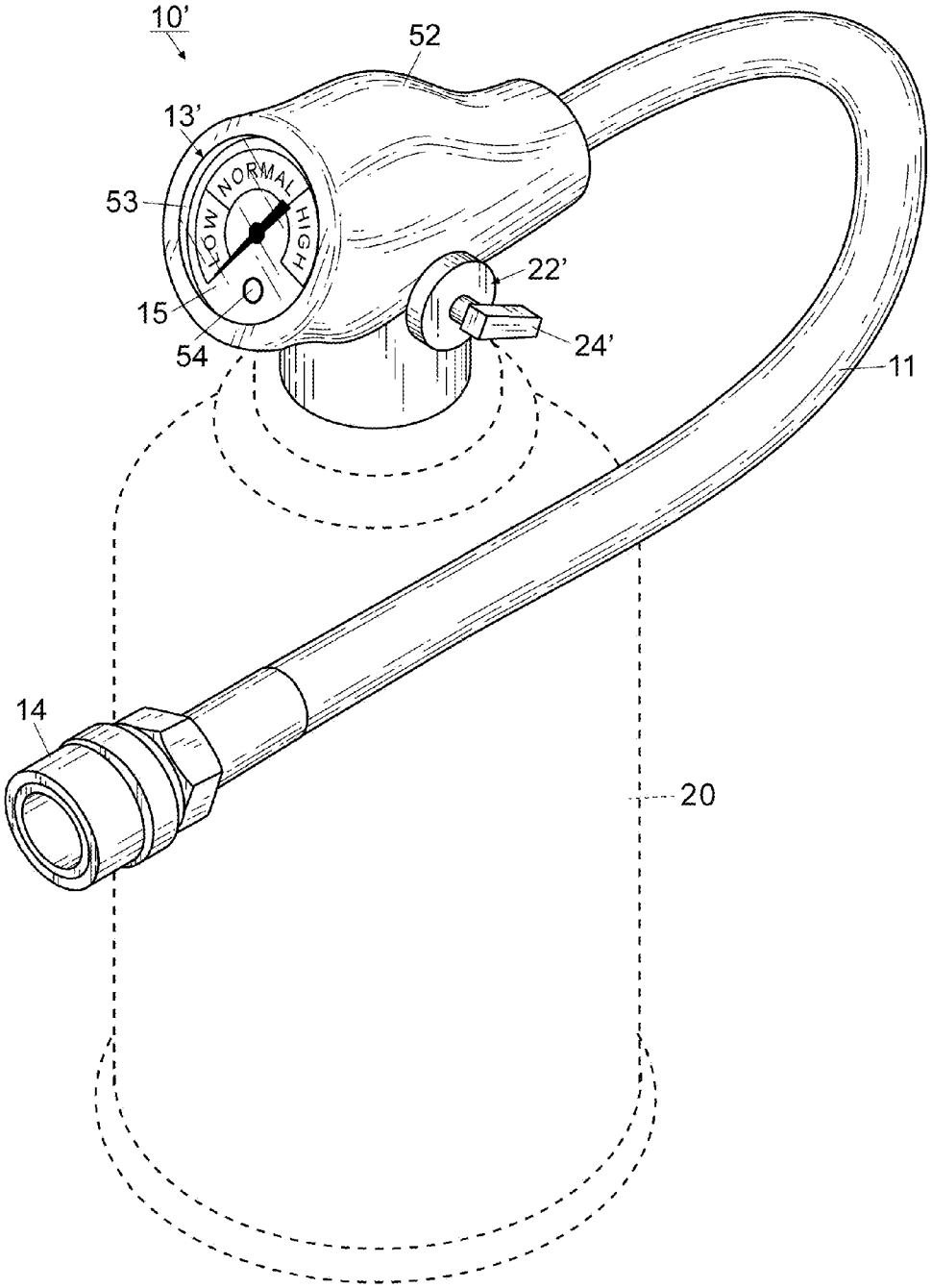
FIG. 4 pictures a perspective side view of an alternate embodiment of a charging hose assembly.
Figure 5:
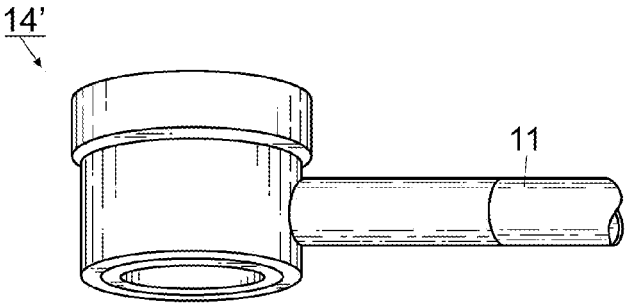
FIG. 5 depicts an elevated side view of an alternate embodiment of the hose coupler of FIG. 4.
Figure 6:
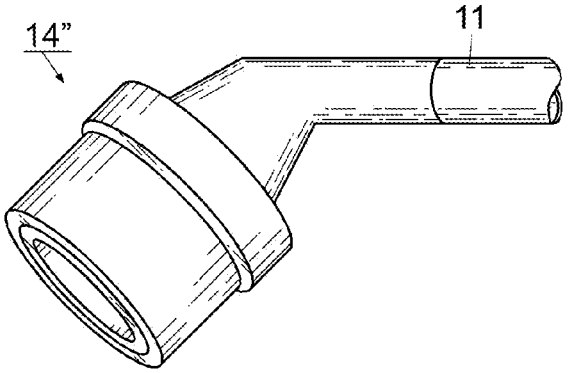
FIG. 6 features an elevated side view of an alternate embodiment of the hose coupler of FIG. 4.
Figure 7:
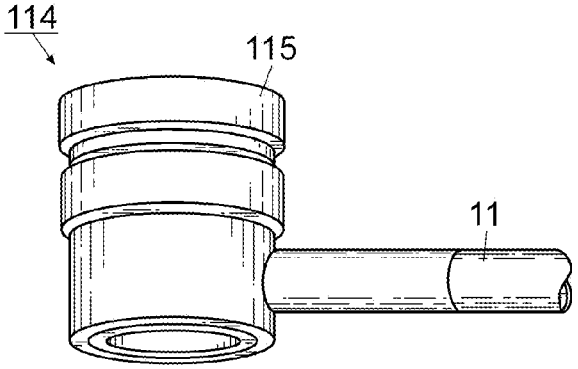
FIG. 7 demonstrates an elevated side view of an alternate embodiment of the hose coupler of FIG. 4.
Figure 8:
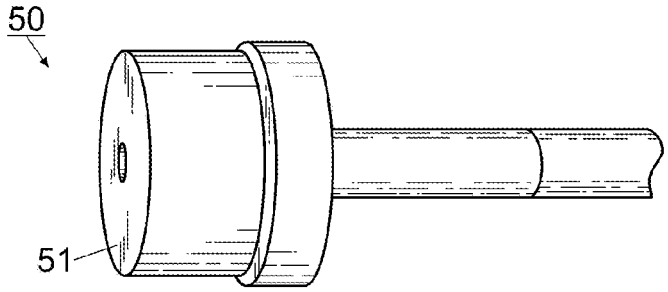
FIG. 8 illustrates an elevated side view of an alternate embodiment of the hose coupler of FIG. 4.

An alternate embodiment of charging hose assembly 10' (FIG. 4) includes coupler 14 affixed to a terminal end of flexible hose section 11. Service port inlet coupler 14 may be a conventional quick coupler which is normally closed but other embodiments such as ninety degree (90°) coupler 14' as illustrated in FIG. 5 configured for vertical engagement or a forty-five degree (45°) coupler 14" as illustrated in FIG. 6 configured for angular engagement may be employed depending on the particular manufacturer and system to be serviced. Service port inlet coupler 14 and alternative embodiments thereof engage standard inlet 25 of vehicle air conditioning system 28 (shown schematically in FIG. 1) for fluid flow therebetween. Alternate embodiment service port inlet coupler 114 may be considered a manual coupler, as opposed to a quick coupler, in that manual coupler 114 (displayed in FIG. 7) includes knob 115 that frictionally engages inlet 25. With the application of rotational force as would be understood, the body of manual coupler 114 is lowered on to and frictional engages inlet 25, opening a fluid passage between embodiments of hose assembly 10 and air conditioning system 28, until such time as opposing rotational force is applied to handle 115 and the pressure biased inlet 25 closes. For example, inlet 25 may include a pin (not shown) that is depressed by a pin in coplanar and parallel orientation within manual coupler 114 when manual coupler 114 is engaged with air conditioning system 28. In another example, embodiments of couplers 14 and 114 may be an anti-blowback coupler 50 (shown in FIG. 8), which as would be understood may include shoulder 51 configured to depress the pin of inlet 25 as described above.

Figure 9:
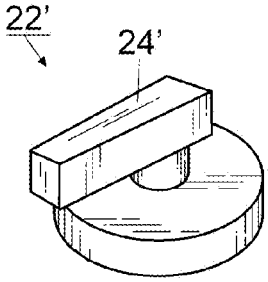
FIG. 9 shows the shut-off valve of FIG. 4 in a first position.
Figure 9A:
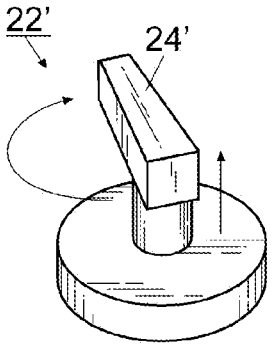
FIG. 9A pictures the shut-off valve of FIG. 9 in a second position.

Embodiments of hose assembly 10 may further include secured quick turn shut-off valve 22', preferably positioned at an end of hose 11 opposing embodiments of coupler 14. Hose assembly 10' may include secured quick turn shut-off valve 22' in communication with hose 11 and positioned on external housing 52 as illustrated in FIG. 4. Similar to quick turn shut-off valve 22, secured quick turn shut-off valve 22' is positioned for convenience and rapid operation and easy adjustment of refrigerant gas flow, thus allowing a technician to more precisely add the correct amount of refrigerant gas to charge air conditioning system 28. Further, servicing is faster and safer in that the refrigerant gas flow from refrigerant gas canister 20 can be cut-off quickly by rotatable knob 24' of shut-off valve 22', if necessary. In addition, secured quick-turn shut-off valve 22' allows embodiments of hose assembly 10 to remain joined to refrigerant gas canister 20 after charging or testing is completed. Secured shut-off valve 22' further allows the technician to check the pressure of air conditioning system 28 while refrigerant gas canister 20 is connected and during the process of charging vehicle air conditioning system 28. When secured quick turn shut-off valve 22' is closed by knob 24', the pressure of vehicle air conditioning system 28 is tested and as necessary, secured quick turn shut-off valve 22' can be opened by knob 24' to finish charging air conditioning system 28 from refrigerant gas canister 20. Secured quick turn shut-off valve 22' differs from quick turn shut-off valve 22 in that to prevent inadvertent rotational displacement, secured quick turn shut-off valve 22' may be manipulated in more than a rotational manner. For example, knob 24' of preferred secured quick turn shut-off valve 22' includes a "locking" feature and may be vertically displaced (i.e. pushed "in" or pulled "out") as displayed in FIGS. 9 and 9A (only showing the pulled "out" embodiment") before rotation can commence, preventing fluid communication from can 20 and air conditioning system 28 from being established or terminated inadvertently. Further, the locking feature may be automatically engaged when shut-off valve 22' is manipulated into the closed position.

Alternative embodiments of hose assembly 10' may include pressure gauge 13' in fluid communication with hose section 11 (represented in cross-section in FIG. 11) and positioned on housing 52 with a face 15 with charge (zone) markings 16 indicating a low charge (low pressure), a normal charge or high pressure connected to the other end. Charge markings 16 may be indicated by numbers, colors or both. Embodiments of gauge 13' may include O-ring 53 formed from rubber or some other cushioning material to protect gauge 13' from damage resulting from impact. Alternate embodiments of gauge 13' may also include an illumination source such as light 54 powered by battery 55, shown in dotted fashion to indicate placement within housing 52 in FIG. 11. Other illuminating methods, such as luminescent paint, solar powered light emitting diodes (LEDs), or other appropriate lighting sources as are known in the art are equally considered within the scope of the instant invention.

Figure 11:
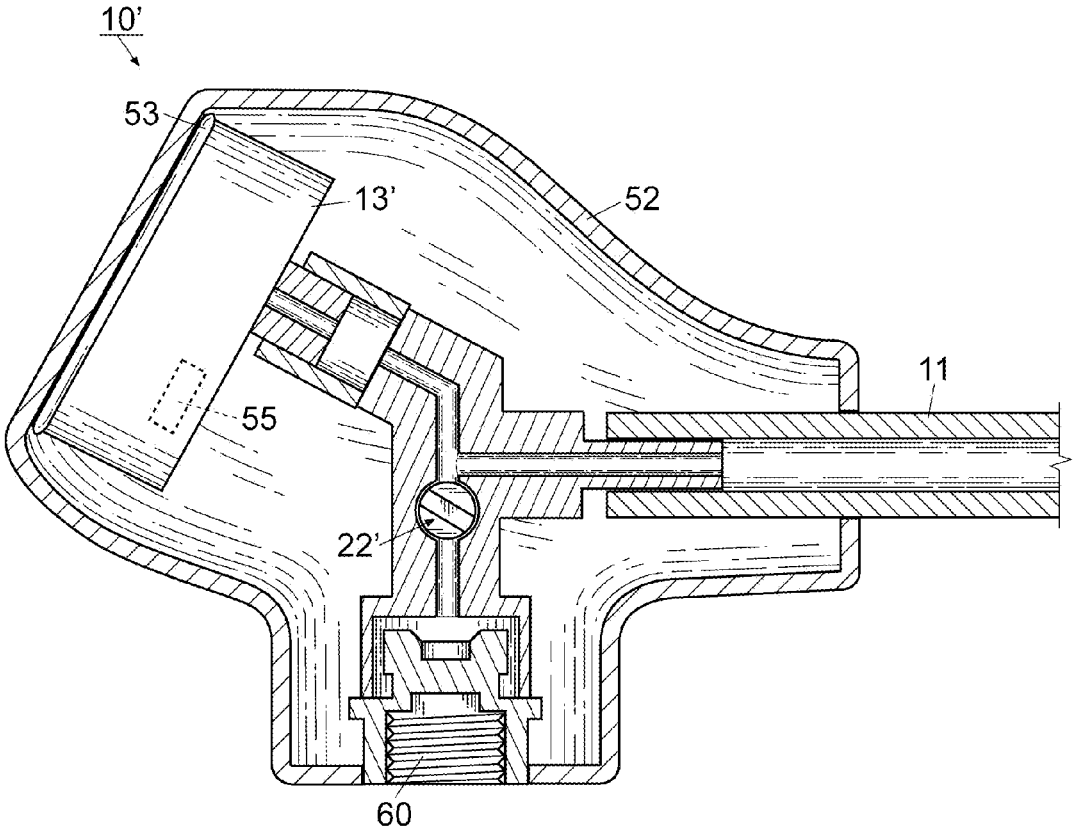
FIG. 11 features an elevated side view of a cross-section of the housing as represented in FIG. 4.
Figure 12:
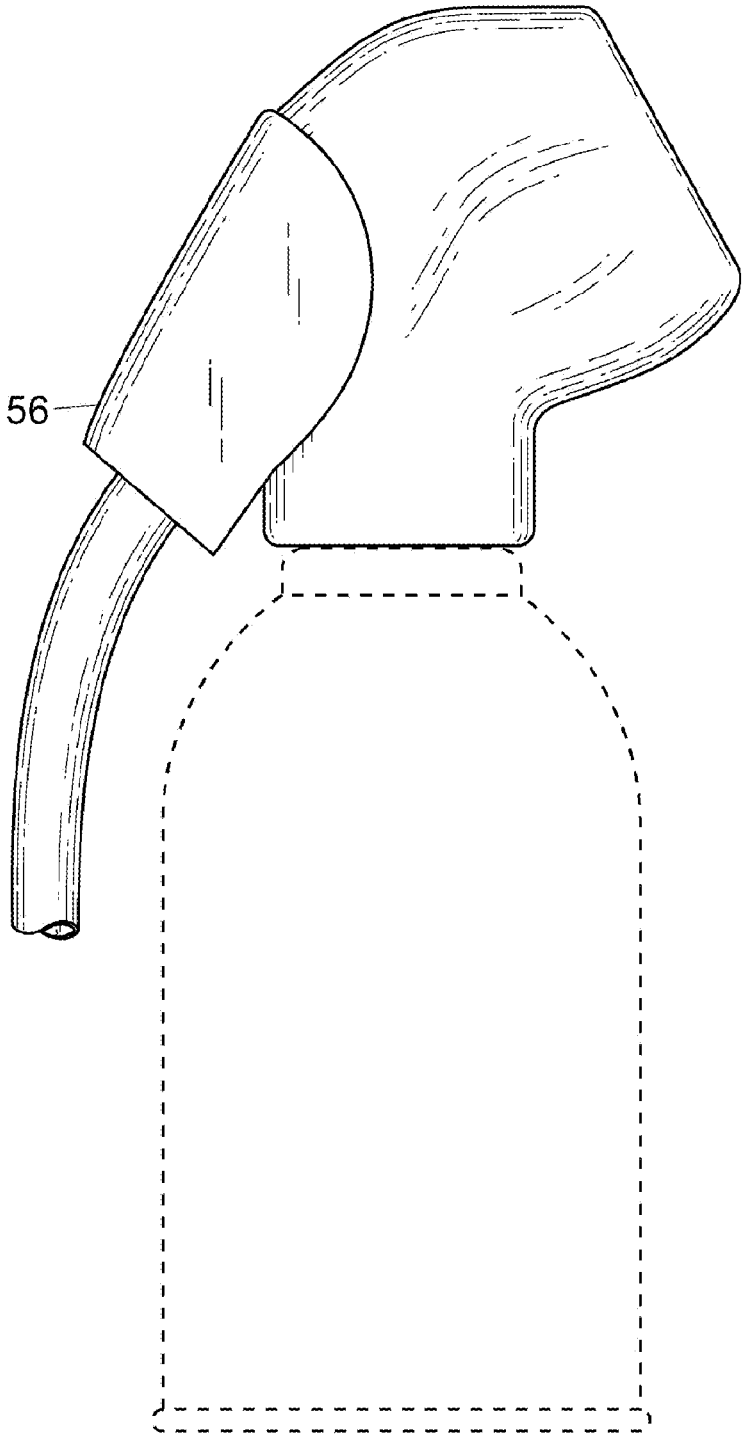
FIG. 12 demonstrates a perspective side view of an embodiment of the hose assembly in FIG. 4 in a first position.
Figure 12A:
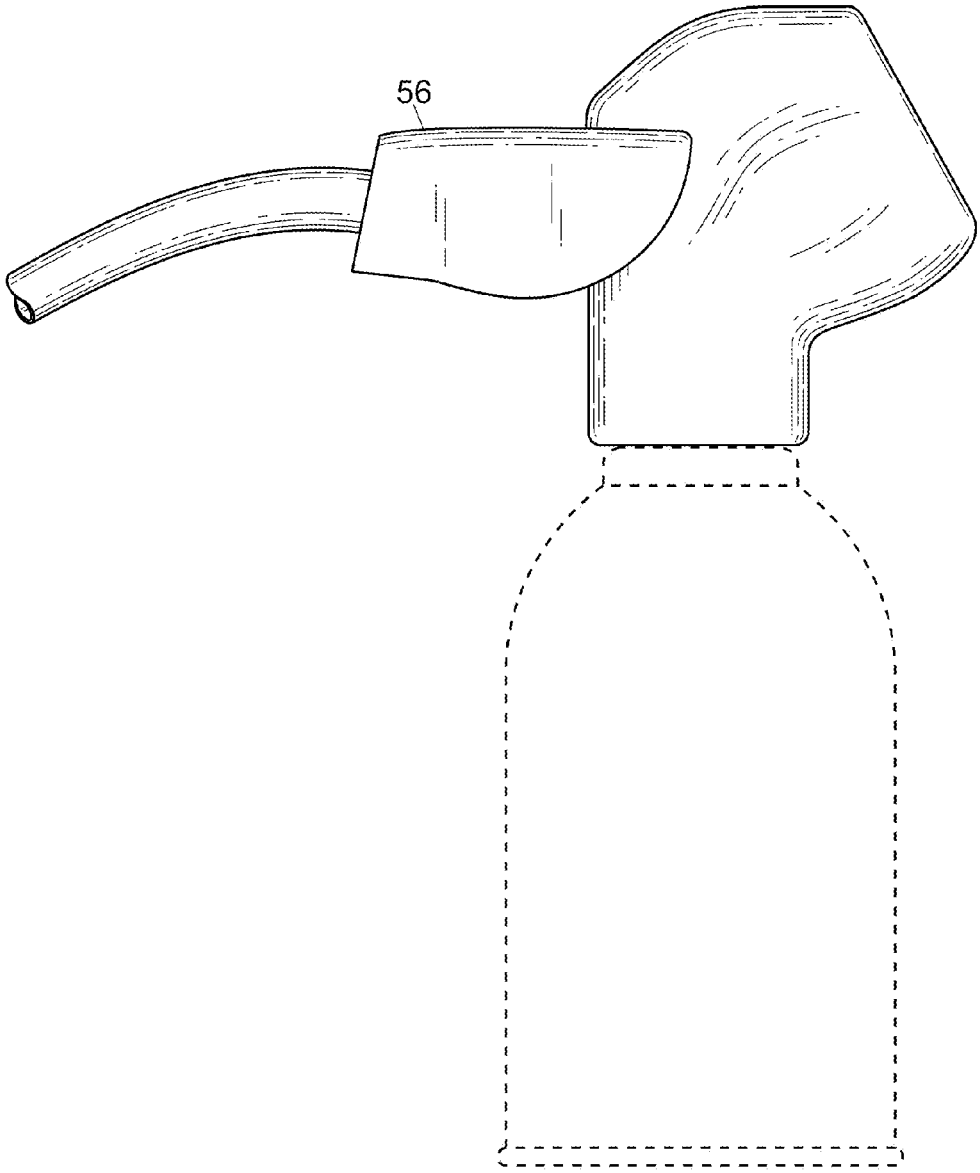
FIG. 12A illustrates a perspective side view of an embodiment of the hose assembly in FIG. 4 in a second position.
Figure 12B:
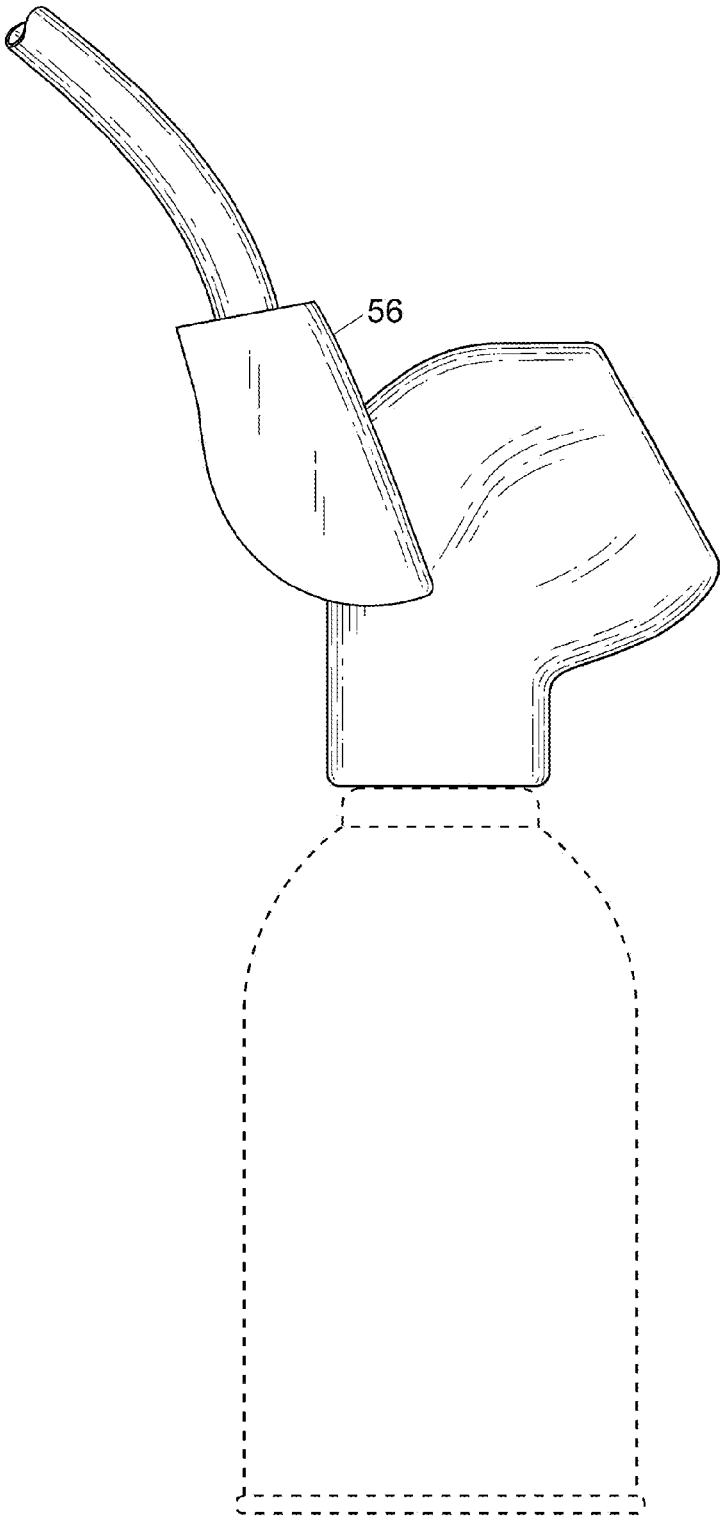
FIG. 12B shows a perspective side view of an embodiment of the hose assembly in FIG. 4 in a third position.

Alternative embodiments of hose assemble 10, 10' may include housing 52, which as is shown in FIGS. 4 and 12-12B, is configured to receive hose 11 and establish a fluid connection between species of coupler 14 and refrigerant can 20 as illustrated in FIG. 11. Housing 52 includes threads 60 for threadable attachment to refrigerant can 20. Embodiments of housing 52 may define a stationary fitting to hose 11 as displayed in FIG. 4, or housing 52 may include rotatable fitting 56 as represented schematically in FIGS. 12-12B. In the rotatable embodiment, hose 11 remains in fluid contact with refrigerant can 20, but the engagement between housing 52 and hose 11 may further include rotatable fitting 56, permitting hose 11 and species of coupler 14 and 114 to extend longitudinally relative to can 20 in the substantially downward position (referred to as the first position and demonstrated in FIG. 12), extend laterally relative to can 20 in the substantially rightward or leftward direction, respectively, (referred to as the second position and shown in FIG. 12A), and extend longitudinally relative to can 20 in the substantially upward position (referred to as the third position and illustrated in FIG. 12B). Rotatable fitting 56 is generally cylindrical in shape and is cooperatively positioned with housing 52, such that if a user wishes to extend embodiments of coupler 14, 114 into an inconvenient location, such as the tight confines of the engine compartment within an exotic sports car, rotatable fitting 56 can accommodate this action without substantial discomfort to the user. It should be understood that rotatable fitting 56 can rotate in either the clockwise or counter-clockwise direction, and nothing in the instant description should be construed to limit the associated hardware of rotatable fitting 56, for examples, washers, lock washers, gaskets, and the like (not shown). It is intended that rotatable fitting 56 is properly configured by one of ordinary skill in the art to serve its intended purpose of permitting three hundred sixty degrees (360°) rotation. Similarly, although this motion is described as "rotatable", an embodiment of housing 52 is within the scope of the instant invention that includes a pivotable, as opposed to a rotatable, housing (not shown) which pivots upwardly and downwardly in a full one hundred and eighty degree (180°) arch.

Figure 10:
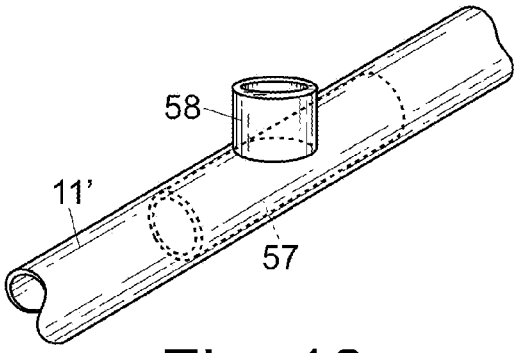
FIG. 10 pictures a perspective side view of an alternate embodiment of the hose as shown in the assembly of FIG. 4.

FIG. 10 pictures a perspective side view of an alternate embodiment of hose assembly 10', including alternate hose 11' defining inline reservoir 57. Before, during, or after the administration of refrigerant from refrigerant can 20, it may be desirous to introduce an additional substance, such as a refrigerant additive, to air conditioning system 28. A user of hose assembly 10, 10' is forced either to deliver the additive prior to utilizing hose assembly 10, 10', or after use of hose assembly 10, 10' has ceased. In either case, it is difficult to calculate the exact amount of additive received at all reaches of air conditioning system 28, and waste is a certainty. However, port 58 in fluid communication with inline reservoir 57 positioned within hose 11' allows the user to administer the additive during refrigerant charging activities, ensuring that the correct amount of additive is provided directly into the refrigerant stream entering air conditioning system 28.

The illustrations and examples provided herein are for explanatory purposes and are not intended to limit the scope of the appended claims.

I claim:

1. An air conditioning charging hose assembly comprising:

a service port inlet coupler affixed to a first end of a fluid channel, said service port inlet coupler comprising a pair of opposing coupler openings oriented parallel to and in coaxial relationship with the fluid channel, a refrigerant supply fitting abutting a shut-off valve and affixed to a second end of the fluid channel within a housing, wherein the first end and the second end of the fluid channel are located at opposite ends of said fluid channel, the supply fitting comprising a first fitting inlet portion and a second fitting inlet portion, the first fitting inlet portion being in a coaxial relationship with the second end of the fluid channel, wherein an interior surface of the second end of the fluid channel abuts the exterior surface of the first fitting inlet portion, the second fitting inlet portion being oriented perpendicular to the first fitting inlet portion and containing a needle within the second fitting inlet portion, and a pressure gauge defining a plurality of charge markings, said pressure gauge being positioned in communication with the fluid channel between the service port inlet coupler and the shut-off valve, wherein said shut-off valve operates in an open position and a closed position, and wherein when said shut-off valve is in the open position and said service port inlet coupler is opened, refrigerant from a refrigerant source is supplied to the air conditioner system, and when said shut-off valve is in the open position and said service port inlet coupler is closed, pressure of the refrigerant source is measured by said pressure gauge, whereby the refrigerant supply fitting and the shut-off valve limit release of refrigerant into the atmosphere and aid in the precise addition of refrigerant into the air conditioning system.

2. The air conditioning charging hose assembly of claim 1 wherein the service port inlet coupler is a manual coupler.

3. The air conditioning charging hose assembly of claim 1 wherein the service port inlet coupler is a quick coupler.

4. The air conditioning charging hose assembly of claim 3 wherein one of the pair of opposing coupler openings is oriented perpendicular to the fluid channel.

5. The air conditioning charging hose assembly of claim 3 wherein one of the pair of opposing coupler openings is oriented angularly to the fluid channel.

6. The air conditioning charging hose assembly of claim 1 wherein the service port inlet coupler is an anti-blowback coupler.

7. The air conditioning charging hose assembly of claim 1, wherein said shut-off valve is a locking shut-off valve.

8. The air conditioning charging hose assembly of claim 7 comprising a knob on the locking shut-off valve.

9. The air conditioning charging hose assembly of claim 8 wherein the knob is configured for vertical and rotational displacement.

10. The air conditioning charging hose assembly of claim 1 comprising an illumination source positioned proximate the pressure gauge.

11. The air conditioning charging hose assembly of claim 10 further comprising a battery positioned within the housing to power the illumination source.

12. The air conditioning charging hose assembly of claim 1 comprising an O-ring positioned about the pressure gauge.

13. The air conditioning charging hose assembly of claim 12 wherein the O-ring is formed from rubber.

14. The air conditioning charging hose assembly of claim 1 further comprising a reservoir positioned within the fluid channel.

15. The air conditioning charging hose assembly of claim 14 further comprising a port in fluid communication with the reservoir.

16. The air conditioning charging hose assembly of claim 1 comprising a rotatable fitting in communication with the fluid channel and engaged with the housing.

17. The air conditioning charging hose assembly of claim 16 wherein the rotatable fitting is configured to rotate from a first position to a second position.

18. The air conditioning charging hose assembly of claim 16 wherein the rotatable fitting is configured to rotate from a first position to a third position.

19. The air conditioning charging hose assembly of claim 16 wherein the rotatable fitting is configured to rotate between a first, a second, and a third position.

* * * * *